US010518314B2

(12) United States Patent
Gailly

(10) Patent No.: US 10,518,314 B2
(45) Date of Patent: Dec. 31, 2019

(54) CAN END PRODUCTION

(71) Applicant: Crown Packaging Technology, Inc., Alsip, IL (US)

(72) Inventor: Noe Jacques Francois Gailly, Paris (FR)

(73) Assignee: Crown Packaging Technology, Inc., Alsip, IL (US)

( * ) Notice: Subject to any disclaimer, the term of this patent is extended or adjusted under 35 U.S.C. 154(b) by 589 days.

(21) Appl. No.: 15/022,774

(22) PCT Filed: Sep. 16, 2014

(86) PCT No.: PCT/EP2014/069735
§ 371 (c)(1),
(2) Date: Mar. 17, 2016

(87) PCT Pub. No.: WO2015/040032
PCT Pub. Date: Mar. 26, 2015

(65) Prior Publication Data

US 2016/0228938 A1 Aug. 11, 2016

(30) Foreign Application Priority Data

Sep. 20, 2013 (EP) ..... 13185408

(51) Int. Cl.
*B21D 51/44* (2006.01)
*B21D 22/22* (2006.01)
*B21D 51/38* (2006.01)

(52) U.S. Cl.
CPC ..... *B21D 51/44* (2013.01); *B21D 22/22* (2013.01); *B21D 51/38* (2013.01)

(58) Field of Classification Search
CPC ..... B21D 51/38; B21D 51/44; B21D 22/225
USPC ..... 72/347, 348
See application file for complete search history.

(56) References Cited

U.S. PATENT DOCUMENTS 4,031,837 A * 6/1977 Jordan ..... B21D 51/44 413/8
4,561,280 A * 12/1985 Bachmann ..... B21D 51/44 72/336
5,149,238 A * 9/1992 McEldowney ..... B21D 51/44 413/8
5,823,040 A 10/1998 Stodd
(Continued)

FOREIGN PATENT DOCUMENTS

DE 29906170 U1 9/1999
EP 0518613 A1 12/1992
(Continued)

OTHER PUBLICATIONS

International Patent Application No. PCT/EP2014/069735: International Search Report and Written opinion dated Nov. 27, 2014, 10 pages.

*Primary Examiner* — Gregory D Swiatocha
(74) *Attorney, Agent, or Firm* — BakerHostetler

(57) ABSTRACT

A method of making a can end by forming a can end shell in a shell press; and converting the shell into a can end. The step of forming the can end shell includes pressing sheet metal into an end shell with a bead feature in the radially outer circumference of its centre panel. In a subsequent can end conversion operation material from the bead feature is used to set final geometry of the converted can end.

11 Claims, 4 Drawing Sheets

(56) References Cited

U.S. PATENT DOCUMENTS

| | | | | |
|---|---|---|---|---|
| 6,702,538 | B1 * | 3/2004 | Heinicke | B21D 51/38<br>413/56 |
| 2003/0075544 | A1 * | 4/2003 | Turner | B21D 51/38<br>220/269 |
| 2014/0110408 | A1 * | 4/2014 | Mitchell | B21D 22/20<br>220/266 |

FOREIGN PATENT DOCUMENTS

| | | | |
|---|---|---|---|
| EP | 2353746 | A1 | 8/2011 |
| WO | WO 01/60546 | A1 | 8/2001 |

* cited by examiner

CAN END PRODUCTION

CROSS-REFERENCE TO RELATED APPLICATIONS

This application is the National Stage of International Application No. PCT/EP2014/069735, filed Sep. 16, 2014, which claims the benefit of EP application number 13185408.5, filed Sep. 20, 2013, the disclosures of which are incorporated herein by reference in their entirety.

TECHNICAL FIELD

This invention relates to the production of a can end. In particular, it relates to the formation of a can end shell in a shell press and the subsequent formation of a can end from that shell in staged operations in a conversion press.

SUMMARY OF INVENTION

According to the present invention, there is provided a method of making a can end, the method comprising: forming a can end shell in a shell press; and converting the shell into a can end; in which the step of forming the can end shell comprises pressing sheet metal into a shell, the shell having a seaming panel, countersink bead and center panel; in which the step of pressing the shell further includes forming one or more features in the center panel of the end. The method further comprising transferring the can end shell to a conversion press and, in a sequence of operations, moving material inwardly from the end shell feature towards the center of the end to set the final geometry of the can end, without changing countersink features radially outwardly from the lowermost point of the countersink bead.

The center panel of the shell is radially inward of the seaming panel and countersink.

The step of pressing the shell may, in one embodiment, form a higher center panel, sometime referred to as a "panel step", by using a deeper center pad in a shell press. Alternatively, the pressing step may comprise forming a dished center panel. Yet another forming step may comprise forming one or more steps or even a series of beads or corrugations in the center panel.

A most preferred step of pressing the shell may comprise forming a bead in the radially outer circumference of the center panel.

According to another aspect of the present invention there is provided an apparatus for forming a can end from an end shell, the apparatus comprising a shell press 20 with shell tooling having: upper tooling 24 including punch 26 having a punch nose 28; and lower tooling 30 comprising a cut edge; a draw ring; a die center pad 32 and die center ring 34; in which the die center pad further includes a protrusion for forming a feature in a center panel of the end shell.

The apparatus may typically further comprise a conversion press 22 with tooling stations 23 for a sequence of operations, at least one of the tooling stations 23 being adapted to move material from the feature of the end shell formed in the shell press.

BRIEF DESCRIPTION OF DRAWINGS

A preferred embodiment of the present invention is now described with reference to the drawings, in which.

DESCRIPTION OF EMBODIMENTS

Figure 1:
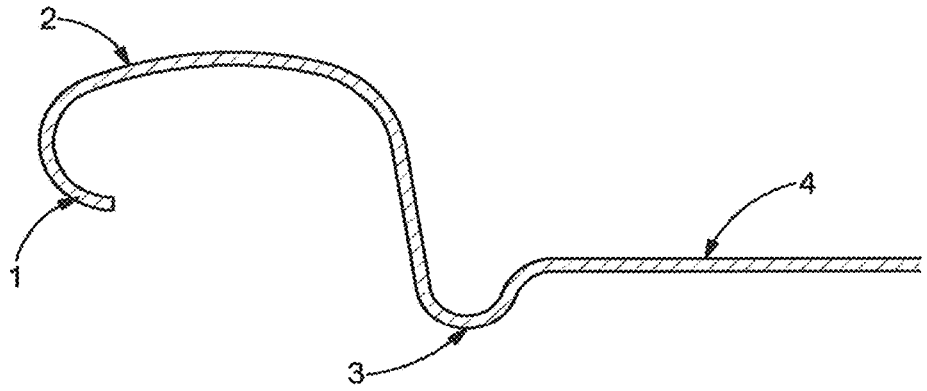
Figure 1 (PRIOR ART)
FIG. 1 is a side section of a conventional end shell.

FIG. 1 is a side section of a conventional end shell for forming a can end.

Figure 2:
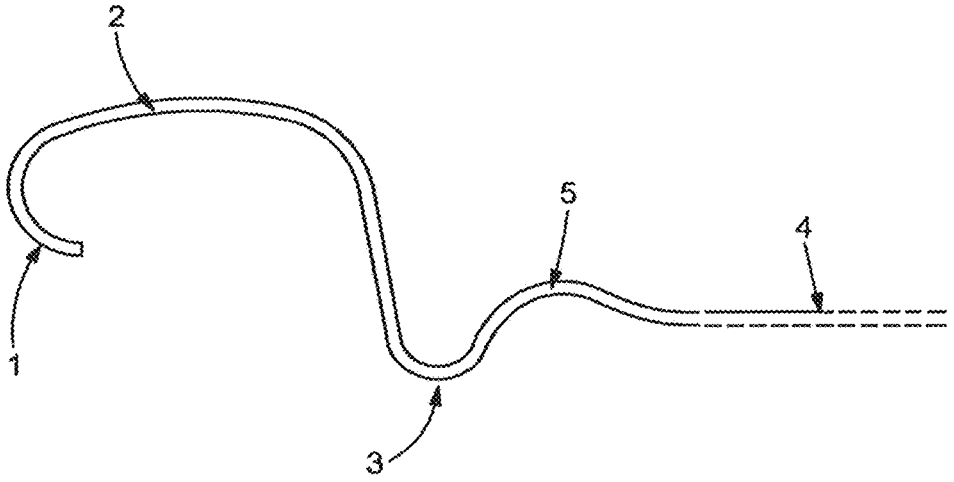
FIG. 2 is a side section of an end shell in accordance with one example of the invention.

FIG. 2 is a side section of a beaded shell according to one embodiment of the invention. The shell edge is formed with a peripheral curl 1. An annular seaming panel 2 is connected by a wall to countersink bead 3 which surrounds center panel 4. An upwardly convex annular bead 5 between the countersink 3 and the center panel 4 has been provided so as to provide material for use during conversion to an easy open end.

By adding a feature such as bead 5 to the shell in a shell press 20, it is possible to move material inwardly of the countersink bead 3 to the center of the end. The material of the bead is moved in one of a sequence of operations in a conversion press 22 to reform the shell bead 5 into a step 6, a platform and annular bead 7 (FIG. 3).

Figure 3:
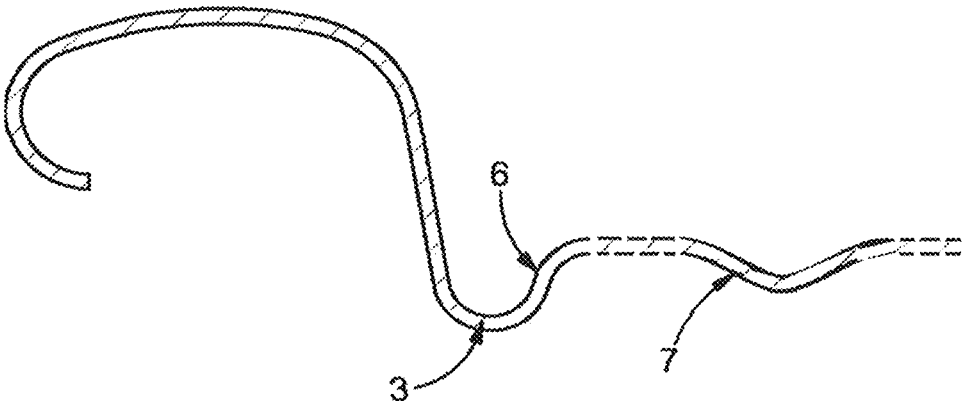
FIG. 3 is a side section of a final converted end, formed from the shell of FIG. 2.
Figure 4:
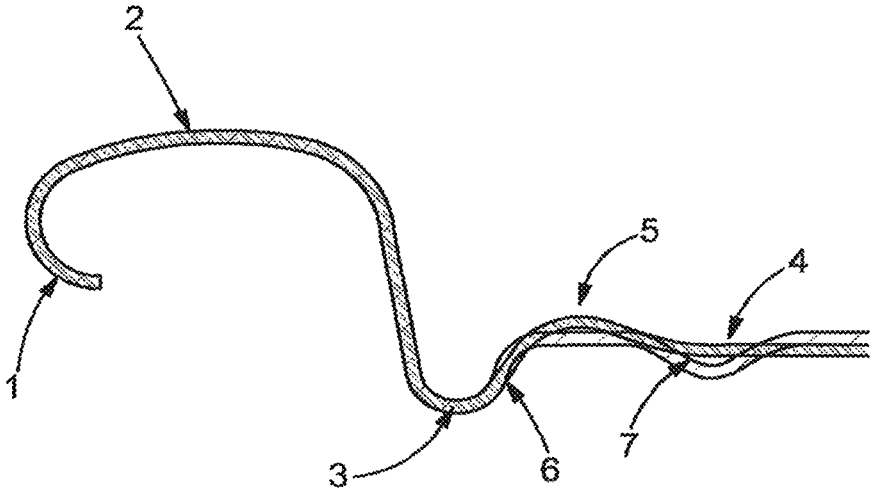
FIG. 4 is overlaid side sections of FIGS. 2 and 3.
Figure 5:
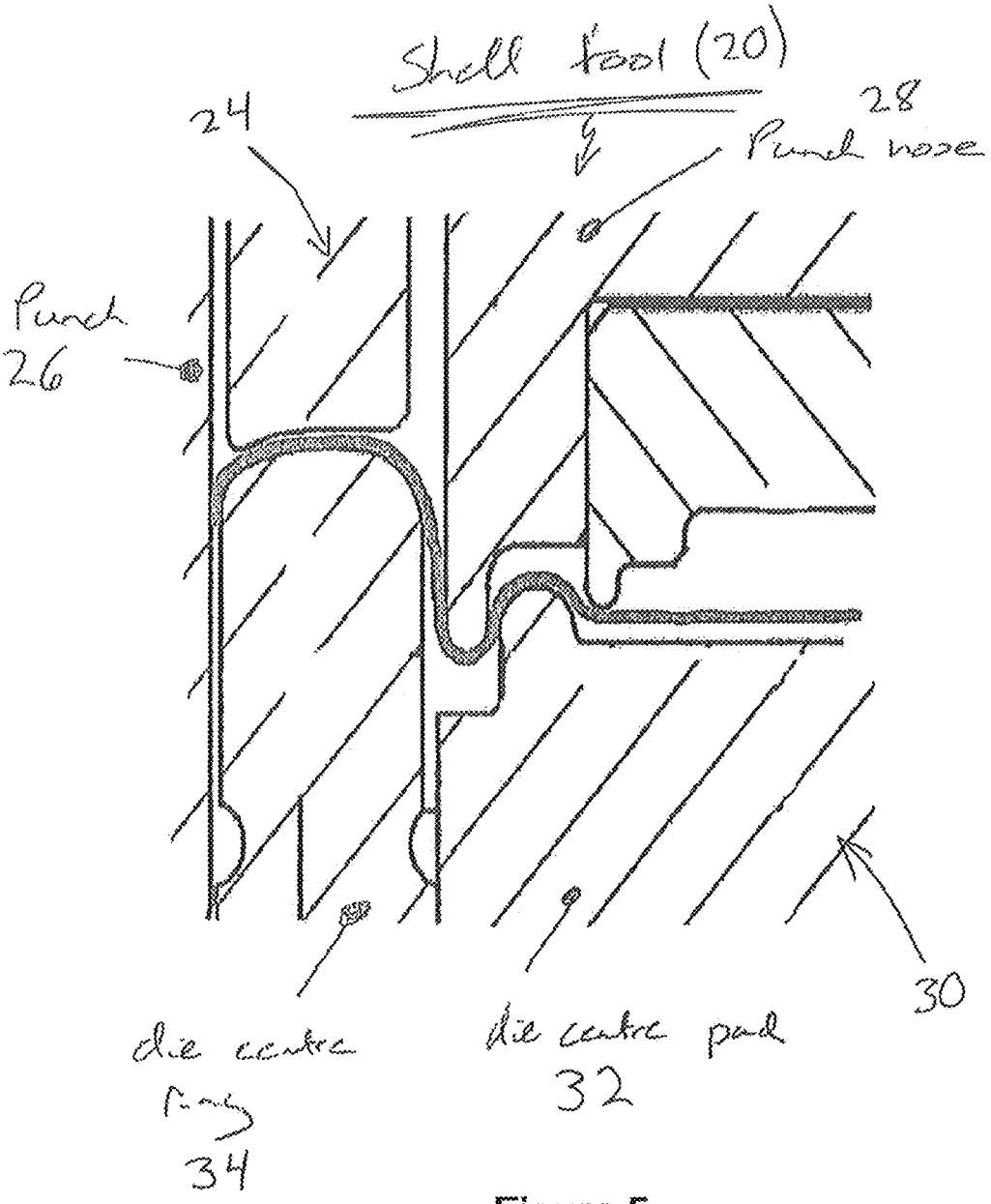
FIG. 5 is a side section of an end shell within a shell press.
Figure 6:
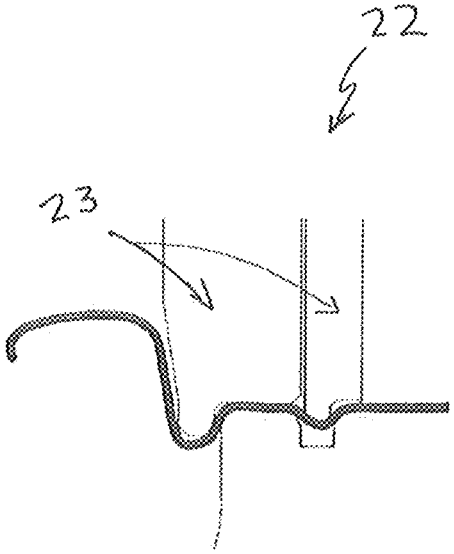
FIG. 6 is a side section of an end shell within a conversion press.

FIG. 4 is an overlay of the side sections of FIGS. 2 and 3. This demonstrates how extra material from the shell bead 5 is used in a panel step 6 and panel bead 7 in the converted end.

Evaluation of performance of the converted end samples has observed that forming a converted end from the shell with a bead generally allows use of material which provides a stronger and more uniform converted shell with improved peak and burst performance.

The invention has been described above by way of example only and changes may be made without departing from the scope of the invention as defined by the claims.

The invention claimed is:

1. A method of making an easy open can end, the method comprising:

forming a can end shell in a shell press, in which the step of forming the can end shell comprises:

pressing a sheet metal material into the can end shell, the step of pressing the sheet metal material into the can end shell includes forming a seaming panel (2), a countersink bead (3) positioned below a center panel (4) in a press direction, and one or more features positioned above the center panel (4) in the press direction, transferring the can end shell to a conversion press, and, in a sequence of operations, moving the sheet metal material composing the one or more features inwardly towards a center of the can end shell to set a final geometry of the easy open can end.

2. The method according to claim 1, in which the step of pressing the sheet metal material forms a panel step by using a deep center pad in the shell press.

3. The method according to claim 1, in which the step of pressing the sheet metal material further comprises forming a dished center panel.

4. The method according to claim 1, in which the step of pressing the sheet metal material further comprises forming one or more steps in the center panel.

5. The method according to claim 1, in which the step of wherein the one or more features includes beads or corrugations in the center panel.

6. The method according to claim 1, in which the step of pressing the sheet metal material further comprises forming the countersink bead in a radially outer circumference of the center panel (4).

7. An apparatus for forming an easy open can end from an end shell, the apparatus comprising:

a shell press with shell tooling having upper tooling including a punch having a punch nose and lower tooling comprising a die center pad and a die center ring, the punch nose being configured to form a countersink, the die center pad including a protrusion for forming a feature between the countersink and a center panel of the end shell, the feature being positioned above the center panel in a press direction and the countersink being positioned below the center panel in the press direction; and a conversion press with tooling stations for a sequence of operations, at least one of the tooling stations being adapted to move material from the feature of the end shell, formed in the shell press, inwardly towards a center of the center panel.

8. A method of making an easy open can end, the method comprising:

pressing a sheet metal material in a shell press to set an initial geometry of the can end, the initial geometry of the can end including a seaming panel, a center panel, a countersink bead positioned below the center panel in a press direction, and one or more features positioned above the center panel in the press direction;

transferring the can end shell to a conversion press; and moving the sheet metal material composing the one or more features inwardly towards a center of the can end to set a final geometry of the can end.

9. The method of claim 8, wherein in the final geometry of the can end, moving the sheet metal material inwardly forms one or more new features positioned below the center panel in the press direction.

10. The method of claim 9, wherein in the final geometry of the can end the one or more new features comprise a concave annular bead.

11. The method of claim 8, wherein in the initial geometry of the can end the one or more features comprise a convex annular bead.

* * * * *